US007882573B2

(12) United States Patent
Kronenberger

(10) Patent No.: US 7,882,573 B2
(45) Date of Patent: Feb. 8, 2011

(54) HEADWEAR PIECE WITH EXPOSED SURFACES HAVING DIFFERENT APPEARANCES

(75) Inventor: Ronald Kronenberger, Riverwoods, IL (US)

(73) Assignee: American Needle, Buffalo Grove, IL (US)

( * ) Notice: Subject to any disclaimer, the term of this patent is extended or adjusted under 35 U.S.C. 154(b) by 792 days.

(21) Appl. No.: 11/713,963

(22) Filed: Feb. 28, 2007

(65) Prior Publication Data

US 2008/0201824 A1 Aug. 28, 2008

(51) Int. Cl.
*A42B 1/00* (2006.01)

(52) U.S. Cl. ..... 2/195.1

(58) Field of Classification Search ..... 2/171.1, 2/171.4, 172, 182.3, 195.1, 209.7, 209.13, 2/209.3, 209.5; 26/28; 40/329, 586; 112/439, 112/475.18; 362/106

See application file for complete search history.

(56) References Cited

U.S. PATENT DOCUMENTS

| | | | | |
|---|---|---|---|---|
| 5,943,702 | A * | 8/1999 | Kronenberger | 2/171.1 |
| 6,044,492 | A * | 4/2000 | Krogh | 2/115 |
| 6,067,660 | A * | 5/2000 | Contini | 2/246 |
| 7,000,553 | B1 * | 2/2006 | Wang | 112/475.11 |
| 7,174,573 | B1 * | 2/2007 | Chen et al. | 2/209.5 |
| 2005/0193768 | A1 * | 9/2005 | Kronenberger | 63/12 |
| 2007/0250988 | A1 * | 11/2007 | Hwang | 2/209.13 |

* cited by examiner

*Primary Examiner*—Katherine Moran
(74) *Attorney, Agent, or Firm*—Wood, Phillips, Katz, Clark & Mortimer

(57) ABSTRACT

A headwear piece with a crown having a wall for embracing a head of a wearer. The wall has an upper layer and an underlying layer. The upper layer has an exposed surface on the crown with a first appearance. The underlying layer has a second appearance that is different than the first appearance. The upper layer is configured to obscurely reveal the second appearance of the underlying layer to be seen in conjunction with the first appearance of the exposed surface on the upper layer.

26 Claims, 4 Drawing Sheets

HEADWEAR PIECE WITH EXPOSED SURFACES HAVING DIFFERENT APPEARANCES

FIELD OF THE INVENTION

This invention relates to headwear, and, more particularly, to a headwear piece having a component with multiple layers that are different in appearance and exposed in a manner to be viewed together.

BACKGROUND ART

The headwear industry is becoming increasingly competitive. Particularly competitive is the segment of the industry that offers baseball-style caps.

Baseball-style caps have evolved from a product once worn primarily by persons participating in the playing of baseball to an every day product that is worn by persons worldwide: a) participating in athletic events; b) engaging in leisure activities; and c) at work. Baseball-style caps are desirable for their comfortable feel, functional features, and aesthetics.

Typically, baseball-style caps are made with lightweight materials that conform readily to different head configurations. A full crown configuration, as opposed to a visor, protects the top region of the user's head, while a brim/bill projects forwardly to shield the user's face from sunshine and the elements, such as rain, snow, etc.

The attraction of the baseball-style cap has spurred an industry that has appealed to a wide range of markets and individual tastes and preferences. These caps can be mass produced in a manner that makes them extremely affordable to any budget. At the same time, high-end caps can be offered to those with more exotic tastes.

Aside from the appeal that the caps offer to the end user, they also offer a valuable tool for promoting businesses, academic institutions, athletic teams, etc. Academic institutions have capitalized on the baseball-style cap as a money generating product that promotes support of the institution and its various programs. These products are made available not only on campuses but geographically over a wide range and at a multitude of different stores.

The objective of modern day designers of baseball-style caps is to offer products that are innovative and capture the attention of an audience that has already been exposed to a multitude of different ornamentation. The industry seeks to generate new interest in products in an industry that is saturated with many permutations of products offered by a multitude of different manufacturers.

One design focus, primarily for the promotion of sports team and academic institutions, is to innovatively use colors that represent the team/institution. The industry continues to seek out creative ways to capitalize on the recognition of these identifying colors in marketing goods for the particular team/institution using the colors in novel patterns and arrangements.

SUMMARY OF THE INVENTION

The invention, in one form, is directed to a headwear piece with a crown having a wall for embracing a head of a wearer. The wall has an upper layer and an underlying layer. The upper layer has an exposed surface on the crown with a first appearance. The underlying layer has a second appearance that is different than the first appearance. The upper layer is configured to obscurely reveal the second appearance of the underlying layer in conjunction with the first appearance of the exposed surface on the upper layer.

In one form of the invention, the first and second appearances are respectively first and second different colors collectively associated with one of an institution and an organization.

In one form, the headwear piece includes an identification associated with the one of the institution and organization, in addition to the first and second colors, that is exposed to view in conjunction with the first and second colors.

The headwear piece may further have a brim/bill extending angularly away from the crown, with the identification provided on at least one of the crown and brim/bill.

In one form, the upper layer is made up of a fabric with intermeshed fibers and the fabric is treated so that the second appearance is revealed through a collection of intermeshed fibers on the upper layer.

In one form, the exposed surface has an inverted cup shape and the upper layer has at least one discrete opening that does not significantly alter the continuity of the exposed surface of the upper layer.

The upper layer may have at least one slit through which the second appearance of the underlying layer is revealed.

In one form, the upper and underlying layers are separate pre-formed layers that are joined directly to each other.

The upper and underlying layers may alternatively be formed together with a unitary construction.

At least portions of the upper and underlying layer may be spaced, each from the other, in yet another form.

In one form, the upper and underlying layers are made of a fabric with intermeshed fibers.

In another form, a headwear piece has a crown with a first wall for embracing a head of a wearer. A second wall defines a brim/bill projecting angularly away from the crown. At least one of the first and second walls has an upper layer and an underlying layer. The upper layer has an exposed surface on the crown with a first color. The underlying layer has a second color that is different than the first color. The first and second colors are collectively associated with one of an institution and an organization. The second color is exposed to view through the upper layer so that the first and second colors are exposed to view together at the at least one of the first and second walls.

In one form, the headwear piece includes an identification associated with the one of the institution and organization, in addition to the first and second colors, that is exposed to view in conjunction with the first and second colors.

In one form, the upper layer is made of a fabric with intermeshed fibers and the fabric is treated so that the second appearance is revealed through a collection of intermeshed fibers on the upper layer.

In one form, the exposed surface has an inverted cup shape and the upper layer has at least one discrete opening that does not significantly alter the continuity of the exposed surface of the upper layer.

The upper layer may have at least one slit through which the second appearance of the underlying layer is revealed.

In one form, the upper and underlying layers are separate pre-formed layers that are joined directly to each other.

The upper and underlying layers may be formed together with a unitary construction.

In another form, a headwear piece is provided with a crown having a first wall for embracing a head of a wearer. A second wall defines a brim/bill projecting angularly away from the crown. At least one of the first and second walls has an upper layer and an underlying layer. The upper layer has an exposed surface with a first appearance. The underlying layer has a second appearance that is different than the first appearance. The upper layer is configured to obscurely reveal the second appearance of the underlying layer in conjunction with the first appearance of the exposed surface on the upper layer.

In one form, the first and second appearances are respectively first and second different colors collectively associated with one of an institution and an organization.

In one form, the headwear piece has an identification associated with the one of the institution and organization, in addition to the first and second colors, that is exposed to view in conjunction with the first and second colors.

In one form, the upper layer is made from a fabric with intermeshed fibers and the fabric is treated so that the second appearance is revealed through a collection of intermeshed fibers on the upper layer.

In one form, the exposed surface has an inverted cup shape and the upper layer has at least one discrete opening that does not significantly alter the continuity of the exposed surface of the upper layer.

The upper layer may have at least one slit through which the second appearance of the underlying layer is revealed.

The upper and underlying layers may be separate preformed layers that are joined directly to each other.

The upper and underlying layers may alternatively be formed together with a unitary construction.

In another form, at least portions of the upper and underlying layer are spaced, each from the other.

DETAILED DESCRIPTION OF THE DRAWINGS

Figure 1:
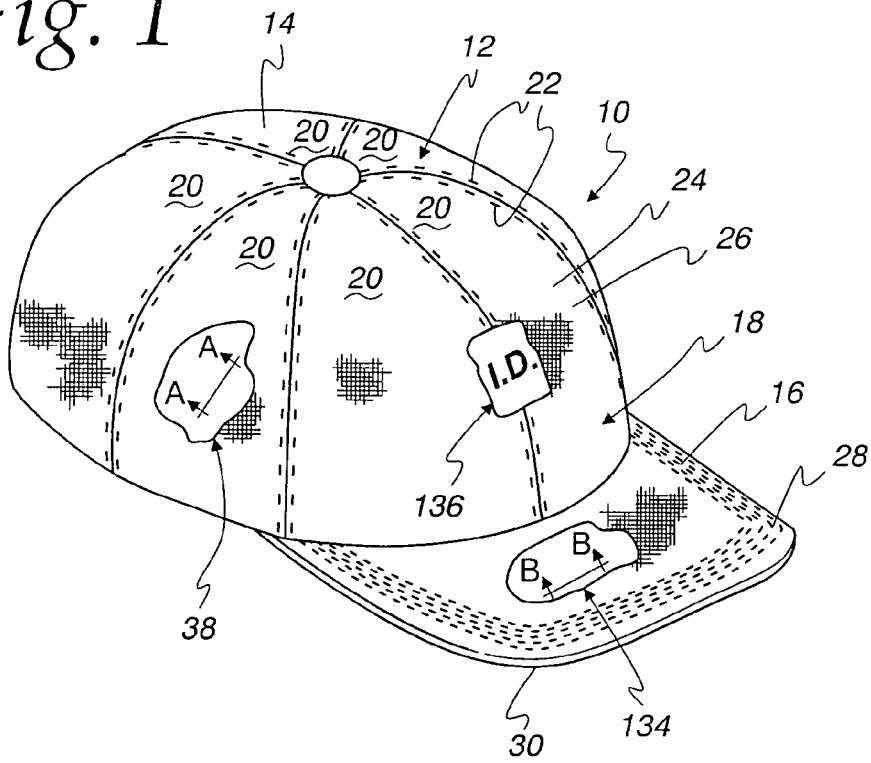
FIG. 1 is a perspective view of one form of headwear piece with a crown and brim/bill having walls made with multiple layers according to the present invention.

In FIG. 1, an exemplary headwear piece, made according to the present invention, is shown at 10. The headwear piece 10 is generally referred to as a baseball-style cap consisting of a crown 12 having a cup-shaped wall 14 for embracing the head of a wearer. A separate wall 16 defines a brim/bill that projects angularly away from a front region 18 of the crown 12.

The crown wall 14 is defined by a plurality of triangularly shaped gores 20, joined edge-to-edge and united by lines of stitching 22 so that the gores 20 collectively produce the inverted cup shape.

Typically, the wall 14 will have an upper layer 24 with an exposed surface at 26. Each gore 20 has a piece that defines a portion of the upper layer 24 so that with the gores 20 sewn together, the exposed surface 26 is continuous over substantially its entire areal extent.

The wall 16 defining the brim/bill has an exposed, upwardly facing surface 28 and an exposed, downwardly facing surface 30. The wall 16 is joined to the crown wall 14 in conventional fashion to produce the configuration shown.

Typically, the crown wall 14 will be made with an outer fabric layer. Liners and backing strips may be applied on the inside of the gores 20.

Similarly, the wall defining the brim/bill 16 may be made from multiple layers for purposes of structural integrity as well as aesthetics.

Figure 2:
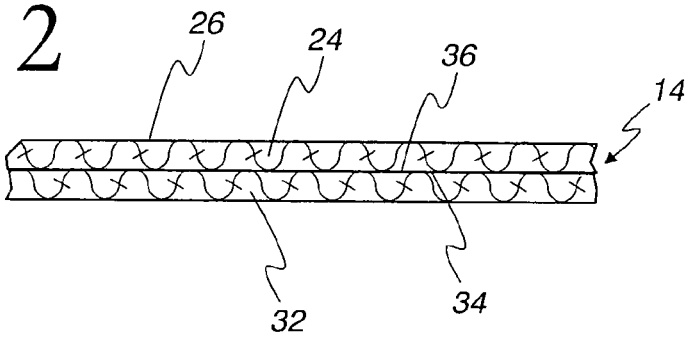
FIG. 2 is a cross-sectional view of the crown wall in FIG. 1 and corresponding crown walls on headwear pieces shown in FIGS. 12 and 13 taken along lines A-A in those Figures.

According to the invention, and as shown additionally in FIG. 2, the crown wall 14 is made with the aforementioned upper layer 24 having the exposed surface 26, and an underlying layer 32. In this embodiment, the layers 24, 32 are separately pre-formed and joined directly to each other with oppositely facing surfaces 34, 36, respectively, facially abutted and suitably secured, as by stitching or otherwise. Additional optional layers (not shown), may be provided for lining, backing, or any other purpose.

According to the invention, at least the exposed surface 26, and potentially the remainder of the thickness of the upper layer 24, have a first appearance, with the underlying layer 32 at the surface 36, and potentially throughout the remainder of the thickness thereof, having a second appearance that is different than the first appearance. The first and second appearances are different enough that there is a clear visual contrast therebetween.

According to the invention, the upper layer 24 is initially formed in a manner, or subsequently treated in a manner, that it becomes configured to obscurely reveal the second appearance of the underlying layer 32 in conjunction with the first appearance of the exposed surface 26 on the upper layer 24.

Whereas it is well known to have two clearly contrasting appearances on the same or different layers, the obscure revealing of the second appearance of the underlying layer 32 affords a unique visual effect. The upper layer 24 may be configured to obscurely reveal the second appearance of the underlying layer 32 over only a portion of the area thereof or over substantially its entire areal extent. For purposes of illustration, the inventive structure will be described with respect to a localized area that is configured in this manner and identified with the arbitrary shape, identified at the location at 38 in FIG. 1. The shape of any discrete area that is configured in this manner is entirely arbitrary. One or more discrete areas can be configured in this manner or, as noted above, the entire areal extent can be configured, as described below. As seen, for example, in FIG. 1, the discrete areas therein have substantial dimensions in transverse directions.

Figure 3:
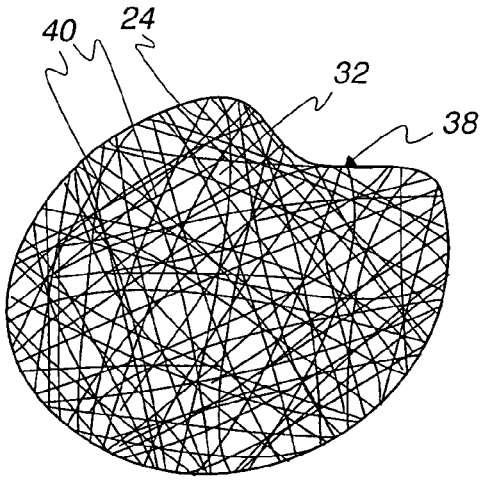
FIG. 3 is an enlarged view of a discrete area at one location on the headwear piece in FIG. 1 wherein an upper layer is configured to expose an underlying layer according to the present invention in a first manner.

For the location 38 in FIG. 3, the upper layer 24 may be made from a fabric material consisting of intermeshed fibers 40. The underlying layer 32 is revealed through a collection of the intermeshed fibers 40 and more specifically through randomly shaped openings defined between the fibers 40 and produced by treating the fabric material as hereinbelow described. This design, like others below, may cause the appearance of the underlying layer 32 to be only faintly viewable. The appearances of the upper layer 24 and underlying layer tend to blend, with the blending effect potentially varying over the area by reason of there being different randomly varying densities of the fibers 40.

This particular fiber arrangement may be achieved through an initial weaving process. Alternatively, a fabric material may be pre-formed and subsequently treated, as by being brushed, sanded, or otherwise worn/altered to eliminate or reposition certain of the fibers 40, while leaving a desired concentration of the fibers 40 in a collection thereof through which the underlying layer 32 is visible.

Figure 4:
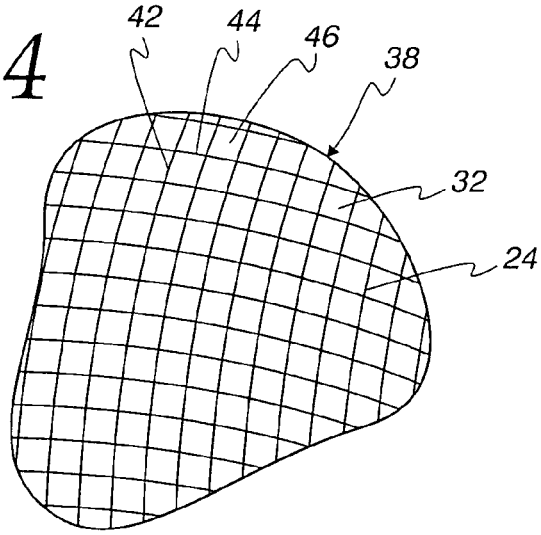
FIG. 4 is a view as in FIG. 3 wherein an upper layer is configured in a different manner to expose the underlying layer.

An alternative configuration of the upper layer 24 is shown in FIG. 4, wherein crossing fibers/yarns 42, 44 produce a regular pattern with openings 46 between the fibers/yarns 40, 42 through which the underlying layer 32 is obscurely revealed. For example, the fibers/yarns 40, 42 may produce a type of netting with a regular pattern. The size of the openings 46, which is somewhat exaggerated in FIG. 4, may be made sufficiently small that the appearance of the underlying layer 32 is not clearly seen therethrough and thus is only faintly viewable. The fibers/yarns 40, 42 may give the effect of shading the underlying layer 32.

Figure 5:
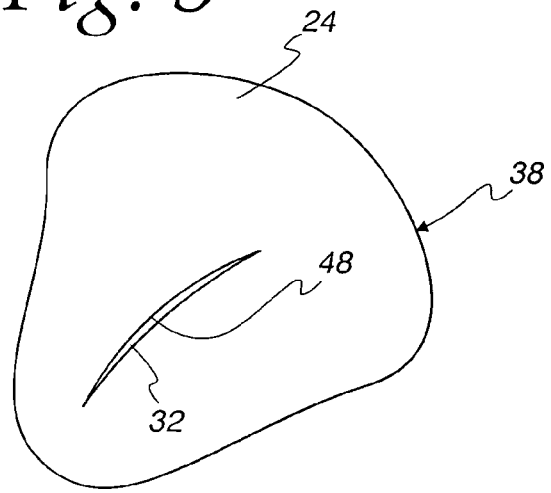
FIG. 5 is a view as in FIGS. 3 and 4 wherein the upper layer is configured in still another different manner to expose the underlying layer.

In FIG. 5, the location at 38 is shown with the upper layer 24 having a narrow slit 48 through which the underlying layer 32 is obscurely revealed. The slit 48 may be sufficiently narrow that the appearance of the underlying layer 32 is only faintly visible. That is, it appears faint and/or slightly shaded by reason of the minimal width of the slit 48.

Figure 6:
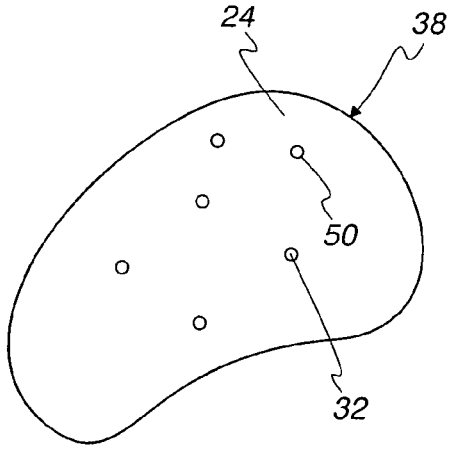
FIG. 6 is a view as in FIGS. 3-5 wherein the upper layer is configured in yet another different manner to expose the underlying layer.

In FIG. 6, a further alternative construction at the location 38 as shown wherein discrete openings 50 are provided in the upper layer 24 to obscurely reveal the underlying layer 32. The size of the openings 50, their shape, and number, may be selected to produce the desired obscure revealing of the appearance of the underlying layer 32.

The configurations for the upper layer 24 in FIGS. 3-6 are exemplary in nature only. There are a multitude of other different ways that the upper layer 24 can be configured, consistently with the teachings herein, to achieve the desired visual effect.

Further, it is also not necessary that the layers 24, 32 be in direct contact, as shown in FIG. 2. As shown for example in FIG. 7, a corresponding upper layer 24' and underlying layer 32' may be spaced, each from the other, over at least a portion of their coextensive area.

Figure 8:
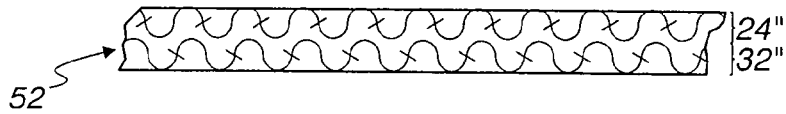
FIG. 8 is a view as in FIGS. 2 and 7 wherein separate layers are related in a different manner and formed together as a unitary structure.

As a still further alternative, as shown in FIG. 8, a multilayer fabric may be formed as shown at 52, wherein corresponding upper and underlying layers 24", 32", respectively, are formed together with a unitary construction.

Figure 9:
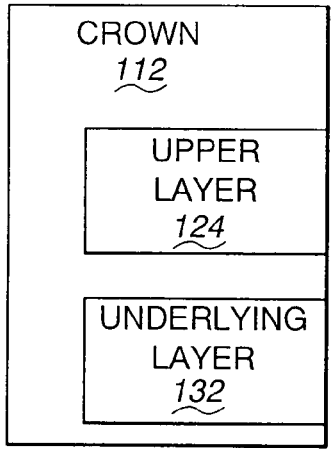
FIG. 9 is a schematic representation of a crown on a headwear piece incorporating upper and underlying layers according to the present invention.

Additionally, while one or both of the layers is desirably made from fabric consisting of intermeshed fibers, as shown in FIG. 9, the invention contemplates more generically that the crown 112 may be made with upper and underlying layers 124, 132, with contrasting appearances, from virtually a limitless number of different materials that are caused to visually contrast by reason of using any of a multitude of different techniques. As just examples, but not for purposes of limitation, the material might be one or more of an animal hide, plastic, cardboard, a composite, etc.

Figure 10:
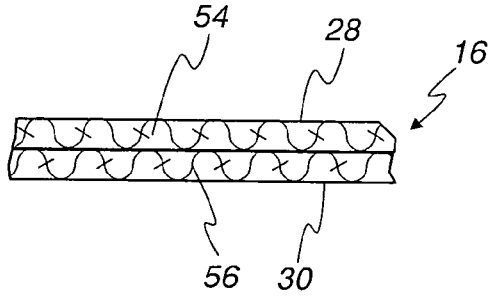
FIG. 10 is a fragmentary, cross-sectional view of a wall on the brim/bill on the headwear piece taken along line B-B of FIG. 1 and along corresponding line B-B in FIG. 13 on the headwear piece shown therein.

As seen additionally in FIG. 10, in conjunction with FIG. 1, the invention contemplates that the wall 16 defining the brim/bill may likewise have a multilayer construction to produce the same unique visual effect at either the exposed upwardly facing surface 28 or the exposed downwardly facing surface 30. The wall 16 consists of an upper/underlying layer 54 and an underlying/upper layer 56, either or both of which may be reconfigured as described for the upper layer 24 to produce the unique visual effect thereat. That is, the layers 54, 56 have a contrasting appearance with one of the layers 54, 56 being obscurely revealed through the other of the layers 54, 56 using the concepts described above.

Figure 7:
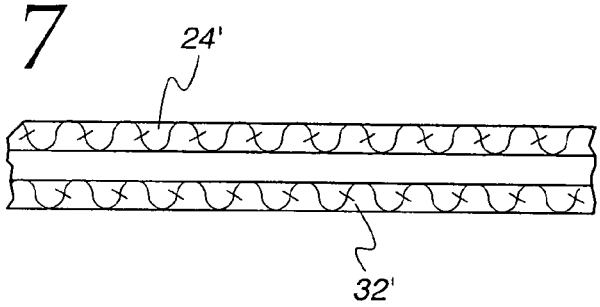
FIG. 7 is a view as in FIG. 2 wherein the layers are related in a different manner to expose the underlying layer.

Further, while the layers 54, 56 are shown in FIG. 10 as fabric layers joined directly, one to the other, the alternative arrangements shown in FIGS. 7 and 8 can likewise be utilized. As shown in FIG. 1, the wall 16 can be formed as described herein locally, as at the location 134, or over one or more other discrete areas, or over the entirety of the areal extent of the wall 16 at its upwardly and/or downwardly facing surfaces 28, 30.

Figure 11:
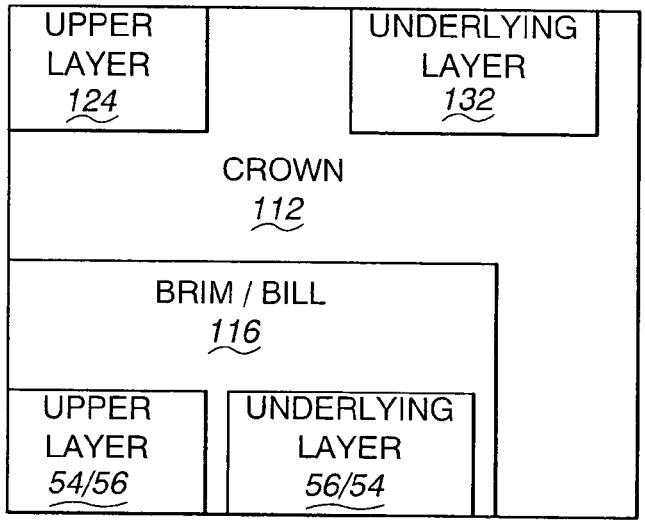
FIG. 11 is a schematic representation of a headwear piece, made according to the present invention, with upper and underlying layers on both a crown and brim/bill.

FIG. 11 depicts a generic form of the structure in FIG. 1 wherein the aforementioned crown construction shown in FIG. 9 is included together with a generic form of brim/bill 116 having upper and underlying layers 54/56; 56/54 that may be made from any type of material with a contrasting appearance as described herein. This generic showing is made to emphasize that the forms of the invention specifically depicted are not limiting in nature.

In one form of the invention, the first and second appearances of the exemplary upper and underlying layers 24, 32 are attributable to first and second different colors collectively associated with one of an institution and an organization. As used herein, "institution" and "organization" are intended to encompass virtually any type of entity that uses specific colors to identify itself. For example, an academic institution and its athletic teams may use blue and gold for its identifying colors. The upper layer 24 may be colored blue, with the underlying layer 32 colored gold, or vice versa.

As additionally shown in FIG. 1, the headwear piece 10 may include an identification as shown at 136 associated with the one of the institution and organization, in addition to the first and second colors, that is exposed to view in conjunction with the first and second colors. The identification 136 is shown generically to encompass virtually any type of identification that an institution may utilize, be it words, a number, a logo, etc. The identification may be provided at any location on the crown 12 and/or brim/bill or at multiple locations on either or both.

Figure 12:
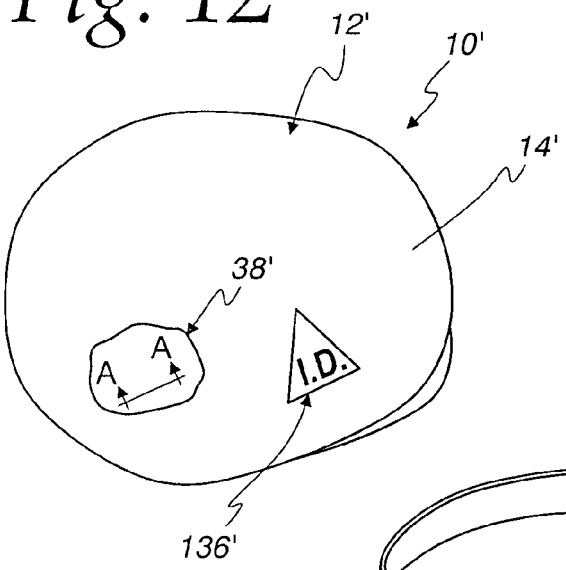
FIG. 12 is a perspective view of a further modified form of headwear piece incorporating the present invention.

It is not necessary that the headwear piece have the baseball-style cap configuration shown in FIG. 1. For example, as shown in FIG. 12, a headwear piece is shown at 10' consisting of a crown 12' without any associated brim/bill. The wall 14' on the crown 12' has at least a portion thereof, shown at a location 38', that has the configuration shown for the crown wall 14 at 38 in FIG. 1. The crown may optionally include an identification 136' thereon at any location.

Figure 13:
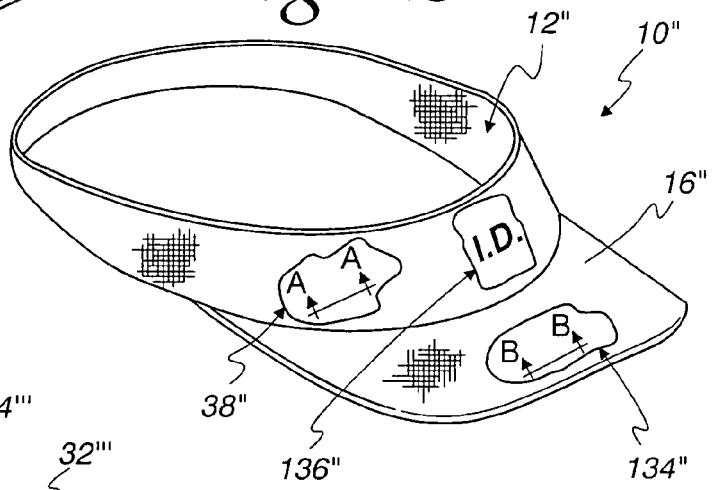
FIG. 13 is a perspective view of a still further modified form of headwear piece, incorporating the present invention.

In FIG. 13, a further modified form of headwear piece is shown at 10" incorporating the inventive concept. The headwear piece 10" is a conventional visor construction with an open crown 12" having a portion thereof at the location 38"

configured as for the headwear piece 10 at the location 38. The headwear piece 10 has a wall 16" defining a brim/bill which may optionally be configured at a location 134" in the same manner that the wall 16 is configured at the location 134 in FIG. 1. An optional identification 136" may be provided on the headwear piece 10".

The invention contemplates other headwear configurations, such as, for example, one incorporating a crown with a continuous brim around its periphery. Virtually any type of headwear piece with a crown that embraces a wearer's head can incorporate the inventive concepts.

Figure 14:
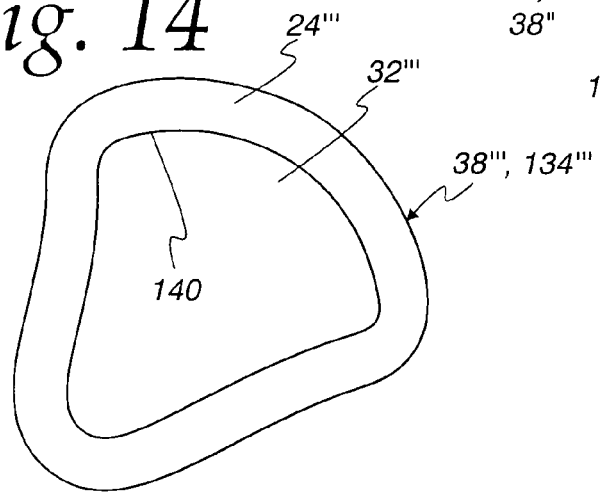
FIG. 14 is a view as in FIGS. 3-6 wherein an upper layer is configured in a different manner than as shown in FIGS. 3-6.

In FIG. 14, a further modified form of the invention is shown for incorporation into a headwear piece at a crown and/or brim/bill at corresponding locations 38''', 134''', respectively. In this embodiment, the upper layer 24''' has a substantially sized opening 140 through which an underlying layer 32''' is exposed more obviously so that the appearance is clearly seen. In this embodiment, it is contemplated that the different appearances of the layers 24''', 32''' be attributable to different colors thereof. More specifically, the different colors are each associated with one of an institution and an organization, as described above. The first and second colors are viewable together at an exposed surface on a crown and/or brim/bill.

Figure 15:
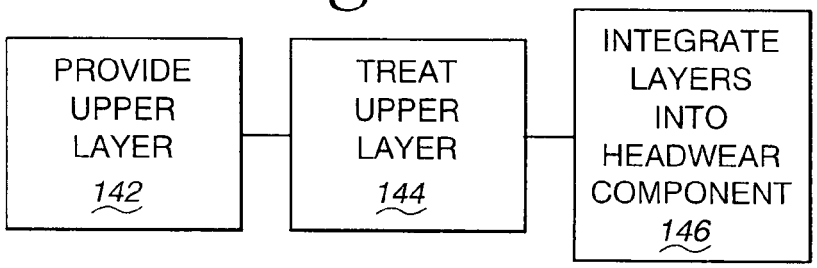
FIG. 15 is a schematic representation of one method of making a headwear component according to the present invention.

The invention contemplates virtually an unlimited number of different ways to make the components of the headwear piece. As shown in FIG. 15, one exemplary method involves providing an upper layer, as shown at block 142. The upper layer is treated at time of initial manufacture or subsequently, as shown at block 144, to allow revealing of an underlying layer. The upper and underlying layers are integrated into a headwear component, as shown at block 146. The layers may be pre-treated prior to their interconnection or connected and subsequently treated.

As noted above, any area from a small discrete area, or multiple discrete areas, to an entire area of a crown and/or brim/bill that is exposed may be formed according to the invention. In the event that less than the entire area of the crown and/or brim/bill is formed as described above, the area(s) may be at any location and in any shape.

Regardless of where and how the upper layer is treated, in one form of the invention, it is preferred that the underlying layer be exposed in conjunction with the upper layer in a subtle fashion that the appearance of the underlying layer accents the appearance of the upper layer. The area of exposure of the underlying layer may be minimal, as through an opening having a small effective diameter, or a narrow slit. The exposure may be faint or shaded/shadowed. The cap may be constructed so that the crown might be slightly stretched, occurring through placement on a wearer's head, to even cause the revealing of the underlying layer. The opening size and number may be such that the continuity of the crown or brim/bill is not significantly altered.

The foregoing disclosure of specific embodiments is intended to be illustrative of the broad concepts comprehended by the invention.

The invention claimed is:

1. A headwear piece comprising:

a crown comprising a wall for embracing a head of a wearer, the wall comprising an upper layer and an underlying layer, the upper layer having an exposed surface on the crown and having a first appearance, the underlying layer having a second appearance that is different than the first appearance, the upper layer configured to obscurely reveal the second appearance of the underlying layer in conjunction with the first appearance of the exposed surface on the upper layer, the upper layer pre-formed and thereafter treated by being altered over an area with substantial dimensions in transverse directions so that the treated upper layer has a varying density at the area and the treating defines openings through which the second appearance is obscurely revealed over the area.

2. The headwear piece according to claim 1 wherein the first and second appearances respectively comprise first and second different colors collectively associated with one of an institution and an organization.

3. The headwear piece according to claim 2 wherein the headwear piece comprises an identification associated with the one of the institution and organization, in addition to the first and second colors, that is exposed to view in conjunction with the first and second colors.

4. The headwear piece according to claim 3 wherein the headwear piece further comprises a brim/bill extending angularly away from the crown and the identification is provided on at least one of the crown and brim/bill.

5. The headwear piece according to claim 1 wherein the upper and underlying layers comprise separate pre-formed layers that are joined directly to each other.

6. The headwear piece according to claim 1 wherein the upper and underlying layers are formed together with a unitary construction.

7. The headwear piece according to claim 1 wherein at least portions of the upper and underlying layers are spaced each from the other.

8. A headwear piece comprising:

a crown comprising a wall for embracing a head of a wearer, the wall comprising an upper layer and an underlying layer, the upper layer having an exposed surface on the crown and having a first appearance, the underlying layer having a second appearance that is different than the first appearance, the upper layer configured to obscurely reveal the second appearance of the underlying layer in conjunction with the first appearance of the exposed surface on the upper layer, the upper layer pre-formed and thereafter treated by being altered over an area, wherein the upper layer comprises a fabric with intermeshed fibers and the fabric is treated at the area so that the second appearance is revealed through a collection of intermeshed fibers of randomly varying densities on the upper layer.

9. A headwear piece comprising:

a crown comprising a wall for embracing a head of a wearer, the wall comprising an upper layer and an underlying layer, the upper layer having an exposed surface on the crown and having a first appearance, the underlying layer having a second appearance that is different than the first appearance, the upper layer configured to obscurely reveal the second appearance of the underlying layer in conjunction with the first appearance of the exposed surface on the upper layer, the upper layer pre-formed and thereafter treated by being altered over an area so that the treated upper layer has a varying density at the area and the treating defines openings through which the second appearance is obscurely revealed, wherein the area is treated by at least one of brushing and sanding.

10. The headwear piece according to claim 9 wherein the upper layer comprises fibers at the area through which the second appearance of the underlying layer is revealed.

11. A headwear piece comprising:

a crown comprising a wall for embracing a head of a wearer, the wall comprising an upper layer and an underlying layer, the upper layer having an exposed surface on the crown and having a first appearance, the underlying layer having a second appearance that is different than the first appearance, the upper layer configured to obscurely reveal the second appearance of the underlying layer in conjunction with the first appearance of the exposed surface on the upper layer, the upper layer pre-formed and thereafter treated by being altered over an area, wherein the upper and underlying layers each comprises a fabric with intermeshed fibers and the altered area has substantial dimensions in transverse directions.

12. A headwear piece comprising:

a crown comprising a first wall for embracing a head of a wearer; and a second wall defining a brim/bill projecting angularly away from the crown; and at least one of the first and second walls comprising an upper layer and an underlying layer, the upper layer having an exposed surface on the crown and having a first color, the upper layer comprising fibers, the underlying layer having a second color that is different than the first color, the first and second colors collectively associated with one of an institution and an organization, wherein the second color is exposed to view through the upper layer by pre-forming and thereafter treating the upper layer over an area with substantial dimensions in transverse directions to eliminate or reposition fibers so that the first and second colors are exposed to view together at the at least one of the first and second walls with the second color obscurely viewable through the fibers.

13. The headwear piece according to claim 12 wherein the headwear piece comprises an identification associated with the one of the institution and organization, in addition to the first and second colors, that is exposed to view in conjunction with the first and second colors.

14. The headwear piece according to claim 12 wherein the exposed surface has an inverted cup shape and the upper layer has at least one discrete opening that does not significantly alter continuity of the exposed surface of the upper layer.

15. The headwear piece according to claim 12 wherein the upper and underlying layers are formed together with a unitary construction.

16. A headwear piece comprising:

a crown comprising a first wall for embracing a head of a wearer; and a second wall defining a brim/bill projecting angularly away from the crown; and at least one of the first and second walls comprising an upper layer and an underlying layer, the upper layer having an exposed surface on the crown and having a first color, the underlying layer having a second color that is different than the first color, the first and second colors collectively associated with one of an institution and an organization, wherein the second color is exposed to view through the upper layer by treating the upper layer so that the first and second colors are exposed to view together at the at least one of the first and second walls, wherein the upper layer comprises a fabric with intermeshed fibers and the fabric is treated by at least one of brushing and sanding so that the second appearance is revealed through a collection of intermeshed fibers on the upper layer.

17. A headwear piece comprising:

a crown comprising a first wall for embracing a head of a wearer; and a second wall defining a brim/bill projecting angularly away from the crown; and at least one of the first and second walls comprising an upper layer and an underlying layer, the upper layer having an exposed surface on the crown and having a first color, the upper layer comprising fibers, the underlying layer having a second color that is different than the first color, the first and second colors collectively associated with one of an institution and an organization, wherein the second color is exposed to view through the upper layer by pre-forming and thereafter treating the upper layer to eliminate or reposition fibers so that the first and second colors are exposed to view together at the at least one of the first and second walls with the second color exposed to view through the fibers, wherein the upper and underlying layers comprises separate pre-formed layers that are joined directly to each other and the upper layer is treated by at least one of brushing and sanding.

18. A headwear piece comprising:

a crown comprising a first wall for embracing a head of a wearer; and a second wall defining a brim/bill projecting angularly away from the crown, at least one of the first and second walls comprising an upper layer and an underlying layer, the upper layer having an exposed surface having a first appearance, the underlying layer having a second appearance that is different than the first appearance, the upper layer configured by pre-forming the upper layer and thereafter treating an area by altering the area of the upper layer to obscurely reveal the second appearance of the underlying layer through openings of different size over the area in conjunction with the first appearance of the exposed surface on the upper layer.

19. The headwear piece according to claim 18 wherein the first and second appearances respectively comprise first and second different colors collectively associated with one of an institution and an organization.

20. The headwear piece according to claim 19 wherein the headwear piece comprises an identification associated with the one of the institution and organization, in addition to the first and second colors, that is exposed to view in conjunction with the first and second colors.

21. The headwear piece according to claim 18 wherein the exposed surface has an inverted cup shape and the upper layer has at least one discrete opening that does not significantly alter continuity of the exposed surface of the upper layer.

22. The headwear piece according to claim 18 wherein the upper and underlying layers comprise separate pre-formed layers that are joined directly to each other.

23. The headwear piece according to claim 18 wherein the upper and underlying layers are formed together with a unitary construction.

24. The headwear piece according to claim 18 wherein at least portions of the upper and underlying layers are spaced each from the other.

25. The headwear piece according to claim 18 wherein the upper layer comprises fibers and the upper layer is treated to eliminate or reposition fibers so that the second appearance of the underlying area is obscurely revealed by the fibers.

26. A headwear piece comprising:

a crown comprising a first wall for embracing a head of a wearer; and a second wall defining a brim/bill projecting angularly away from the crown, at least one of the first and second walls comprising an upper layer and an underlying layer, the upper layer having an exposed surface having a first appearance, the underlying layer having a second appearance that is different than the first appearance, the upper layer configured through treating the upper layer to obscurely reveal the second appearance of the underlying layer in conjunction with the first appearance of the exposed surface on the upper layer, wherein the upper layer comprises a fabric with intermeshed fibers and the fabric is treated by at least one of brushing and sanding so that the second appearance is revealed through a collection of intermeshed fibers on the upper layer.

* * * * *